United States Patent [19]

Suzuki

[11] 4,180,716

[45] Dec. 25, 1979

[54] SWITCH HAVING LOCK-OFF AND LOCK-ON

[75] Inventor: Hideo Suzuki, Yokohama, Japan

[73] Assignee: Fujisoku Electric Co., Ltd., Kawasaki, Japan

[21] Appl. No.: 959,092

[22] Filed: Nov. 9, 1978

[30] Foreign Application Priority Data

Nov. 15, 1977 [JP] Japan ..... 52-153184[U]

[51] Int. Cl.[2] ..... H01H 3/20; H01H 13/08

[52] U.S. Cl. ..... 200/320; 74/531; 200/157; 200/322; 200/325; 200/328

[58] Field of Search ..... 200/157, 318, 320–325, 200/327, 328; 74/529, 531, 532

[56] References Cited

U.S. PATENT DOCUMENTS

| | | | |
|---|---|---|---|
| 3,383,943 | 5/1968 | Piber | 200/157 X |
| 3,550,472 | 12/1970 | Drummer | 200/157 X |
| 3,590,193 | 6/1971 | Frenzel | 200/157 |
| 3,646,291 | 2/1972 | Bienwald et al. | 200/157 X |
| 3,746,813 | 7/1973 | Brown | 200/157 |
| 3,755,640 | 8/1973 | Kaman et al. | 200/157 |
| 3,953,696 | 4/1976 | Reismann et al. | 200/157 |
| 3,971,906 | 7/1976 | Sahrbacker | 200/321 X |

*Primary Examiner*—Stephen Marcus

*Attorney, Agent, or Firm*—Frishauf, Holtz, Goodman & Woodward

[57] ABSTRACT

A lock-off switch comprises a lock plate rotatably disposed on a slider and having a projection at one side and a hole elongated in the lengthwise direction and a pin secured to the slider and loosely fitted in the elongated hole of the lock plate thereby to hold the lock plate rotatably. In the elongated hole of the lock plate a compression spring stretches between the pin and one end of the elongated hole, thus urging the lock plate toward a switch case. The slider has a stopper engageable with the projection of the lock plate thereby to stop the slider. An urging means, such as a compression spring, is provided at the other side of the slider and urging the projection of the lock plate into engagement with the stopper, thereby to prevent the slider from being pushed. To push the slider, the lock plate is rotated against the urging force of the urging means thereby to release the projection of the lock plate from the stopper.

8 Claims, 5 Drawing Figures

SWITCH HAVING LOCK-OFF AND LOCK-ON

BACKGROUND OF THE INVENTION

This invention relates to a switch used in, for example, small electrically driven tools, and more particularly to a lock-off switch.

Various gun-shaped electrically driven tools are known. The grip of such a tool is provided with a switch having a trigger-shaped slider. The slider is normally kept in off-position. To drive a motor disposed in the tool, the slider is pulled by the forefinger into on-position. So long as the slider is held in on-position, electric power is kept supplied to the motor.

An accidental pulling of the trigger-shaped slider results in an accidental rotation of a cutter, which is very dangerous. Thus an accidental pulling of the slider should be avoided. To this end various lock-off switches have been invented. Each of these switches comprises a trigger-shaped slider and a lock means for locking the slider at off-position. The lock means releases the slider when a push shaft protruding from one side of a switch case is pushed. One known lock-off switch comprises a trigger-shaped slider and a push shaft. While held in a first position, the push shaft prevents a pulling of the slider. While kept in a second position, the push shaft can be moved perpendicularly to the axis of the tool so as to allow a pulling of the slider. Another known lock-off switch comprises a switch case, a trigger-shaped slider, a push shaft, a slightly bent leaf spring disposed in the switch case and a compression spring provided beside the leaf spring. The leaf spring is secured to the slider at one end, and its free end has a projection. While the slider is held in off-position, the projection is held in a hole made in a side of the case under an urging force of the compression spring, thereby preventing a pulling of the trigger-shaped slider. To allow a pulling of the slider, the push shaft is pushed to pull the projection out of the hole against the urging force of the compression spring.

SUMMARY OF THE INVENTION

An object of this invention is to provied a lockoff switch which constructionally differs from the known lock-off switches and which is more easily operated and more reliable.

A lock-off switch according to the invention comprises a lock plate rotatably disposed on a slider having a projection at one side and a hole elongated in the lengthwise direction, a pin secured to the slider and loosely fitted in the elongated hole of the lock plate thereby to hold the lock plate rotatably, first urging means disposed in the elongated hole and between the pin and one end of the elongated hole for urging the lock plate toward a switch case, a stopper engageable with the projection of the lock plate for stopping the slider, and second urging means disposed at the other side of the lock plate for urging the projection into engagement with the stopper thereby to prevent a pulling of the slider. To release the projection from the stopper, the lock plate is rotated against the urging force of the second urging means. In this way the slider can be easily brought into on-position.

The above and further objects and novel features of the invention will more fully appear from the following detailed description when the same is read in connection with the accompanying drawings. It is to be expressly understood, however, that the drawings are for purpose of illustration only and is not intented as a definition of the limits of the invention.

DETAILED DESCRIPTION OF THE PREFERRED EMBODIMENTS

Figure 1:
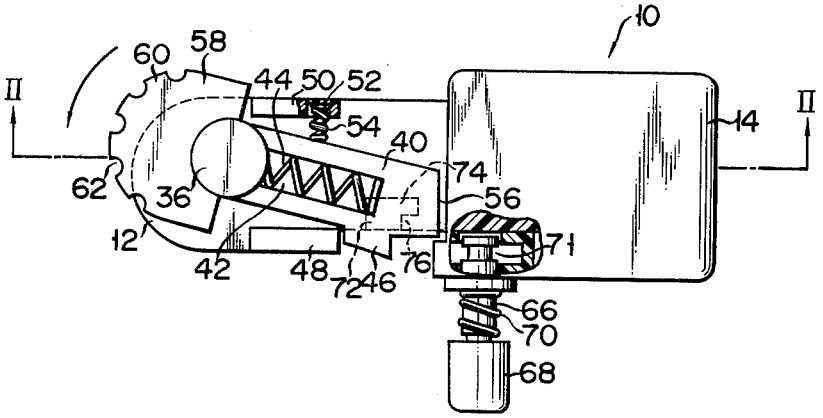
FIG. 1 is a plan view of a lock-off switch according to this invention, which is in off-position.
Figure 2:
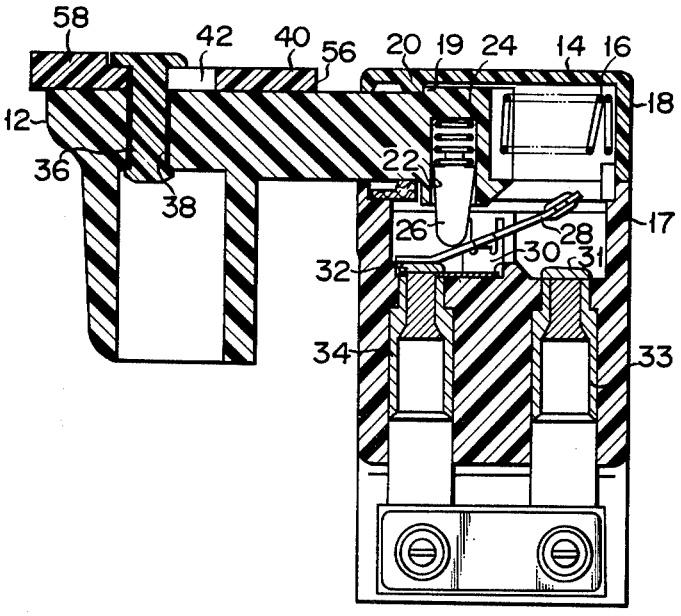
FIG. 2 is a lon itudinal sectional view of the switch shown in FIG. 1, taken along line II—II in FIG. 1.

As shown in FIGS. 1 and 2, a lock-off switch 10 according to this invention comprises a trigger-shaped slider 12 slidably inserted in a switch case 14. The slider 12 is pushed from the front of the case 14 by a compression spring 16 disposed in the case 14. The switch case 14 is constituted by a body 17 and a detachable cover 18. The slider 12 has a stepped portion 19 on the top surface. The stepped portion 19 is in contact with a protrusion 20 formed on the inner surface of the cover 18, thereby preventing the slider 12 from being pushed further by the compression spring 16.

A vertical blind hole 22 is formed in the rear end portion of the slider 12 and opens downwardly. In the blind hole 22 a compression spring 24 is disposed. A pin 26 is loosely fitted in the hole 22 and urged downwardly by the compression spring 24. The rounded lower end of the pin 26 slidably touches a movable contact 28. The movable contact 28 is supported by a fulcrum 30 at its middle portion. The movable contact 28 is rockable about the fulcrum 30. It may rock to come into contact with a stationary on-contact 31 or a stationary off-contact 32. The stationary contacts 31 and 32 are electrically connected to terminals 33 and 34, respectively. These terminals 33 and 34 are connected to lead wires (not shown). The off-contact 32 is electrically connected to the fulcrum.

The trigger-shaped slider 12 has a vertical through hole 38. In the through hole 38 a pin 36 is inserted and is thus secured to the slider 12. On the slider 12 a lock plate 40 is disposed. The lock plate 40 has a hole 42 elongated in the lengthwise direction. The pin 36 is loosely fitted in the elongated hole 42, whereby the lock plate 40 is rotatably disposed on the slider 12. In the elongated hole 42 a first urging or biasing means 44 such as a compression spring extending between the pin 36 and one end of the hole 42, thereby urging the lock plate 40 toward the switch case 14. The lock plate 40 has at one side a projection 46, which is engageable with a stopper 48 formed on the top surface of the slider 12. Further a support 50 is formed also on the top surface of the slider 12. The stopper 48 and the support 50 face each other with the lock plate 40 between them. The support 50 has a hole 52, in which a second urging means 54 such as a compression spring is partly fitted. The second urging means 54 urges the lock plate 40 toward the stopper 48, thus bringing the projection 46 into engagement with the stopper 48.

Unless the projection 46 of the lock plate 40 is disengaged from the stopper 48 formed on the slider 12, the slider 12 cannot be pulled fully. It may be pulled but for a short distance until one end 56 of the plate 40 close to the switch case 14 comes into touch with the front of the switch case 14. The pin 26 is not therefore moved much enough to bring the movable contact 28 into contact with the stationary on-contact 31. The slider 12 thus remains at the off-position however hard it is pulled.

Figure 3:
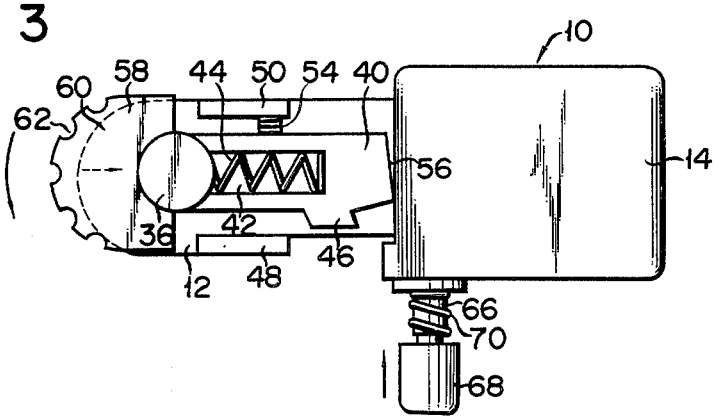
FIG. 3 is a plan view of the lock-off switch with a lock plate rotated to such position as would allow a pulling of a slider.

To release the slider 12 from the off-position, a semicircular plate 58 integrally formed with the other end of the lock plate 40 is rotated in the direction of arrow in FIG. 1. As the plate 58 is rotated in that direction, the projection 46 is disengaged from the stopper 48 as shown in FIG. 3. The slider 12 can then be fully pulled to move the pin 26 much enough to bring the movable contact 28 into contact with the stationary on-contact 31. Preferably the semicircular plate 58 is as large as possible so that it can be rotated with a small force. Further it is desired that a number of grooves 62 be cut in the periphery 60 of the plate 58 thereby to prevent an operator's finger from slipping off the plate 58.

A push shaft 66 is extending through a hole (not shown) made in one side of the switch case 14 so as to lock the slider 12 in the on-position. The push shaft 66 is detachably fitted in the hole (not shown) by means of an E-ring (not shown). A push button 68 is attached to the outer end of the push shaft 66. Between the push button 68 and the case 14 a compression spring 70 is provided on the shaft 66, thus urging the shaft 66 and the button 68 away from the case 14.

As illustrated in FIG. 1, the push shaft 66 has an annular groove 71 at the inner end portion. The slider 12 has an engagement means 72 which is positioned at to face the push shaft 66. When the push shaft 66 is pushed against the urging force of the spring 70 while the slider 12 is put in the on-position, it comes engagement with the engagement means 72. As shown in FIGS. 1 and 2, the engagement means 72 has an engagement recess 74 and an engagement projection 76. The recess 74 is to receive loosely the inner end portion of the push shaft 66. The projection 76 is pushed into the annular groove 71 of the push shaft 66 by the urging force of the compression spring 16 whenever the push shaft 66 is pushed, thereby preventing the push shaft 66 from slipping out of the engagement recess 74.

Figure 4:
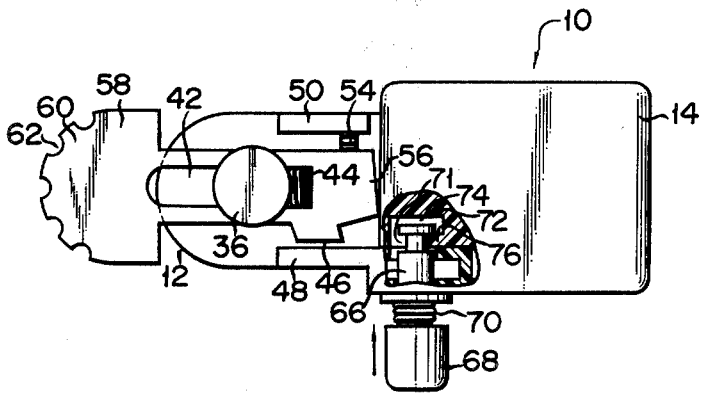
FIG. 4 is a plan view of the lock-off switch, which is in on-position.

With reference to FIGS. 3 and 4 it will now be described how the slider 12 is locked in the on-position. First the slider 12 in such a position as shown in FIG. 3 is pulled. While the slider 12 is kept fully pulled, the push button 68 is pushed against the urging force of the compression spring 70. Then, as shown in FIG. 4, the inner end portion of the push shaft 66 is put into the engagement recess 74. While pushing the push button 68, the operator stops pulling the slider 12. The slider 12 is then pushed forward by the compression spring 16 until the engagement projection 76 is fitted into the annular groove 71 of the push shaft 66. Once the projection 76 has been fitted into the annular groove 71, the push shaft 66 would never be disengaged from the engagement recess 74 even if the push button 68 is no longer pushed. In this way the slider 12 is kept fully pulled or is locked in the on-position.

The trigger-shaped slider is released from the on-position in the following manner. First the slider 12 is pulled a little against the urging force of the compression spring 16 until the engagement projection 76 comes out of the annular groove 71. As soon as the projection 76 slips out of the annular groove 71, the push shaft 66 is automatically disengaged from the engagement recess 74 by the urging force of the compression spring 70. As a result, the slider 12 is automatically brought back to the off-position by the urging force of the compression spring 16.

Figure 5:
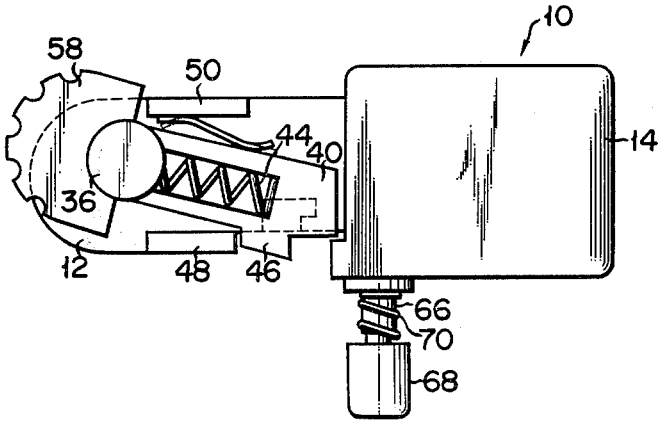
FIG. 5 is a plan view of another lock-off switch according to the invention, which is in off-position.

The second urging means 54 of the lock switch shown in FIGS. 1 to 4 is constituted by a compression spring. Instead of the second urging means may be constituted by, as shown in FIG. 5, a leaf spring which is properly bent and which has one end secured to the support 50 or lock plate 40.

As described above, a lock-off switch according to this invention comprises a lock plate rotatably disposed on a slider and having a projection at one side and a hole elongated in the lengthwise direction, a pin secured to the slider and loosely fitted in the elongated hole of the lock plate thereby to hold the lock plate rotatably, first urging means disposed in the elongated hole and between the pin and one end of the elongated hole for urging the lock plate toward a switch case, a stopper engageable with the projection of the lock plate for stopping the slider, and second urging means disposed at the other side of the lock plate for urging the projecting into engagement with the stopper thereby to prevent a pulling of the slider.

According to the invention, the lock plate is so urged by the second urging means as to have its projection engaged with the stopper, thereby preventing a pulling of the slider or locking the slider in the off-position. The slider can be easily released from the off-position merely by rotating the lock plate about the pin against the urging force of the second urging means. In view of this the lock-off switch of the invention differs from the known lock-off switch wherein a push shaft provided on one side of a switch case is pushed to release a slider from the off-position. Further, in the lock-off switch of the invention the push shaft is pushed to lock the slider in the on-position, whereas the push shaft does not serve to lock the slider in off-position in the known lock-off switch.

This invention therefore provides a lock-off switch with a new lock-off mechanism which differs from those of the conventional lock-off switches. The structure of the lock-off switch according to the invention is simple. And so are the shapes of its parts. Thus the parts can be easily manufactured with a high dimensional precision. In addition, the switch is relatively free from troubles and is therefore reliable.

What is claimed is:

1. A locking switch comprising a switch case, a compression spring disposed in the switch case and a slider which is urged outwardly from the switch case by the compression spring and which can be locked in off-position, said switch further comprising:

a lock plate rotatably disposed on the slider and having a projection at one side thereof and a hole elongated along the length of the lock plate;

a pin secured to the slider and loosely inserted in the elongated hole of the lock plate to rotatably retain the lock plate;

first biasing means disposed in the elongated hole and between the pin and one end of the elongated hole for urging the lock plate toward the switch case;

a stopper engageable with the projection of the lock plate for stopping the slider; and second biasing means disposed at the other side of the lock plate for urging the projection into engagement with the stopper thereby to prevent a pulling of the slider.

2. A locking switch according to claim 1, wherein said lock plate has a member at the end remote from said switch case for smoothly rotating the lock plate against the urging force of said second biasing means.

3. A locking switch according to claim 2, wherein said first and second biasing means each comprises a compression spring.

4. A locking switch according to claim 2, wherein said second biasing means comprises a leaf spring.

5. A locking switch according to any one of claims 1 to 4, further comprising a hole formed in one side of said switch case, a push shaft having an inner end portion extending through said hole in one side of said switch case, and third biasing means for urging said push shaft away from the switch case, said slider having engagement means at one side facing the push shaft, the inner end portion of said push shaft being fitted loosely into the engagement means when said slider is pushed into the switch case, thereby locking the switch in the on position.

6. A locking switch according to claim 5, said inner end portion of said push shaft includes an annular groove and said engagement means comprises a recess for loosely receiving the inner end portion of the push shaft and an engagement projection integrally formed with said slider and urged by said third biasing means into engagement with the annular groove of the push shaft.

7. A locking switch according to claim 4, wherein said second biasing means comprises a leaf spring secured to the lock plate.

8. A locking switch according to claim 4, wherein said second biasing means comprises a leaf spring secured to a support formed on the top surface of the slider at one end thereof.

* * * * *

UNITED STATES PATENT AND TRADEMARK OFFICE

CERTIFICATE OF CORRECTION

PATENT NO. : 4,180,716

DATED : December 25, 1979

INVENTOR(S) : Hideo SUZUKI

It is certified that error appears in the above-identified patent and that said Letters Patent are hereby corrected as shown below:

Claim 2, line 4, change "urging" to --biasing--.

Signed and Sealed this

*Tenth* Day of *June 1980*

[SEAL]

*Attest:*

SIDNEY A. DIAMOND

*Attesting Officer*

*Commissioner of Patents and Trademarks*